US010654269B2

(12) United States Patent
Ishimatsu et al.

(10) Patent No.: US 10,654,269 B2
(45) Date of Patent: May 19, 2020

(54) LIQUID EJECTION HEAD

(71) Applicant: CANON KABUSHIKI KAISHA, Tokyo (JP)

(72) Inventors: Shin Ishimatsu, Yokohama (JP); Toshiaki Hirosawa, Hiratsuka (JP); Genji Inada, Koshigaya (JP); Hiromasa Amma, Kawasaki (JP); Shogo Kawamura, Kawasaki (JP); Yasuhiko Osaki, Kamakura (JP); Takuya Iwano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/006,297

(22) Filed: Jun. 12, 2018

(65) Prior Publication Data

US 2019/0001674 A1 Jan. 3, 2019

(30) Foreign Application Priority Data

Jun. 28, 2017 (JP) ..... 2017-126305

(51) Int. Cl.
*B41J 2/14* (2006.01)
*B41J 2/155* (2006.01)

(52) U.S. Cl.
CPC ..... *B41J 2/14072* (2013.01); *B41J 2/1408* (2013.01); *B41J 2/14024* (2013.01); *B41J 2/155* (2013.01); *B41J 2002/14491* (2013.01); *B41J 2202/12* (2013.01); *B41J 2202/18* (2013.01); *B41J 2202/21* (2013.01)

(58) Field of Classification Search
CPC ..... B41J 2/14072; B41J 2202/18; B41J 2002/14491; B41J 2/1408; B41J 2/14024; B41J 2/155; B41J 2202/21; B41J 2202/12
See application file for complete search history.

(56) References Cited

U.S. PATENT DOCUMENTS

| | | | |
|---|---|---|---|
| 5,670,998 | A | 9/1997 | Shimoda et al. |
| 6,062,675 | A | 5/2000 | Hirosawa et al. |
| 6,378,996 | B1 | 4/2002 | Shimada et al. |
| 6,629,755 | B2 | 10/2003 | Saito et al. |

(Continued)

FOREIGN PATENT DOCUMENTS

| | | | |
|---|---|---|---|
| CN | 101765504 | A | 6/2010 |
| JP | 2012-091510 | A | 5/2012 |

OTHER PUBLICATIONS

Extended European Search Report dated Nov. 19, 2018, issued in European Patent Application No. 18178438.0.

(Continued)

*Primary Examiner* — Geoffrey S Mruk
(74) *Attorney, Agent, or Firm* — Venable LLP

(57) ABSTRACT

A liquid ejection head includes an element substrate including an energy-generating element that applies ejection energy to liquid, a first electric wiring board electrically connected to the element substrate, and a second electric wiring board on which an integrated circuit element is mounted and which is electrically connected to the first electric wiring board. An electric signal is supplied to the integrated circuit element mounted on the second electric wiring board through the first electric wiring board, processed by the integrated circuit element, and supplied to the energy-generating element through the second electric wiring board and the first electric wiring board.

18 Claims, 16 Drawing Sheets

(56) References Cited

U.S. PATENT DOCUMENTS

| | | | | |
|---|---|---|---|---|
| 7,533,960 | B2 | 5/2009 | Yasuda et al. | |
| 7,547,094 | B2 | 6/2009 | Kawamura et al. | |
| 7,686,423 | B2 | 3/2010 | Sato et al. | |
| 7,690,767 | B2 | 4/2010 | Hirosawa et al. | |
| 7,775,638 | B2 | 8/2010 | Hirosawa et al. | |
| 8,177,330 | B2 | 5/2012 | Suganuma et al. | |
| 8,573,748 | B2 | 11/2013 | Kawamura et al. | |
| 8,678,556 | B2 | 3/2014 | Iwanaga et al. | |
| 8,894,185 | B2 | 11/2014 | Yamanaka et al. | |
| 9,156,263 | B2 | 10/2015 | Kodoi et al. | |
| 9,193,154 | B2 | 11/2015 | Toda et al. | |
| 9,238,361 | B2 | 1/2016 | Muraoka et al. | |
| 9,832,864 | B2 | 11/2017 | Iri et al. | |
| 9,884,485 | B2 | 2/2018 | Yoshikawa et al. | |
| 9,902,163 | B2 | 2/2018 | Yoshikawa et al. | |
| 2002/0089574 | A1 | 7/2002 | Yumauchi et al. | |
| 2005/0157057 | A1 | 7/2005 | Silverbrook et al. | |
| 2006/0164466 | A1 | 7/2006 | Mizuno et al. | |
| 2007/0211108 | A1* | 9/2007 | Enomoto ..... | B41J 2/14233 347/50 |

OTHER PUBLICATIONS

Office Action dated Mar. 23, 2020, in Chinese Patent Application No. 201810691329.5.

* cited by examiner

LIQUID EJECTION HEAD

BACKGROUND OF THE INVENTION

Field of the Invention

The present invention relates to a liquid ejection head, and more particularly to a liquid ejection head including an integrated circuit element for processing an electric signal.

Description of the Related Art

A typical liquid ejection apparatus includes a liquid ejection head having an energy-generating element for applying ejection energy to liquid and a flow path member, a conveyance unit for a recording medium, and a control section thereof. A driving power and an electric signal for driving the liquid ejection head are supplied from a control unit to the liquid ejection head via an electric wiring board. In recent years, the demand for high-resolution printing and high-speed printing has increased, and there is an increasing need to process electric signals at a higher speed and to supply them to energy-generating elements. Japanese Patent Application Laid-Open No. 2012-91510 discloses a liquid ejection head in which a driver IC for processing a driving signal (electric signal) is mounted on an electric wiring board. Since the driver IC generates heat when processing the driving signal, the liquid ejection head is provided with a heat insulating member for suppressing heat generated from the driver IC to be transmitted to a flow path member, or a heat radiation unit for letting the generated heat escape to the outside.

As the processing speed of the application specific integrated circuit element (ASIC), which is mounted on the liquid ejection head, for processing electric signals is very high, as described in Japanese Patent Application Laid-Open No. 2012-91510, the integrated circuit element has high temperatures during operation. Since the generated heat of the integrated circuit element changes the viscosity and the like of the liquid to be ejected, the heat may affect the ejection performance. However, since the liquid ejection head described in Japanese Patent Application Laid-Open No. 2012-91510 requires additional members such as a heat insulating member and a heat radiation unit, there is room for improvement from the viewpoint of cost and compactness of the liquid ejection head.

SUMMARY OF THE INVENTION

It is an object of the present invention to provide a liquid ejection head capable of reducing influence of heat generated by an integrated circuit element on ejection performance with a simple configuration.

A liquid ejection head according to the present invention includes an element substrate including an energy-generating element that applies energy for ejecting liquid, a first electric wiring board electrically connected to the element substrate, and a second electric wiring board on which an integrated circuit element is mounted and which is electrically connected to the first electric wiring board. An electric signal is supplied to the integrated circuit element mounted on the second electric wiring board through the first electric wiring board, the electric signal is processed by the integrated circuit element, and the electric signal is supplied to the energy-generating element through the second electric wiring board and the first electric wiring board.

Further features of the present invention will become apparent from the following description of exemplary embodiments with reference to the attached drawings.

DESCRIPTION OF THE EMBODIMENTS

Next, a plurality of embodiments of the liquid ejection head of the present invention will be described with reference to the drawings. The liquid ejection head of the embodiment described below is a so-called page-wide type liquid ejection head. The page-wide type liquid ejection head is fixed to a printer main body so as not to move relative to the printer main body, has a liquid ejection head (line head) having a size corresponding to the width of a recording medium, and performs an recording operation while conveying only the recording medium. The page-wide type liquid ejection head is often used for a liquid ejection apparatus that needs high-speed recording since it can perform many recordings at the same time compared with the serial scan type liquid ejection head, which performs the recording operation while reciprocating a carriage in the width direction of the recording medium. While the present invention is also applicable to a serial scan type liquid ejection head, it is particularly preferably applicable to a page-wide type liquid ejection head. While the liquid ejection head of the present embodiment relates to an ink jet head which ejects ink, the present invention can also be applied to a liquid ejection head which ejects liquid other than ink. In addition, while an energy-generating element of the liquid ejection head of the present embodiment is a heat generating resistive element that applies ejection energy to ink by thermal energy, the element may be a piezoelectric element type.

In the following description and the drawings, the X direction means the longitudinal direction of the liquid ejection head or an element substrate, and coincides with the width direction of the recording medium. The Y direction means the lateral direction of the liquid ejection head or the element substrate, and coincides with the conveyance direction of the recording medium. The Z direction means the direction orthogonal to the surface on which an ejection orifice of the element substrate is formed and coincides with the direction orthogonal to the recording surface of the recording medium. The X direction, Y direction and Z direction are orthogonal to each other.

First Embodiment

Figure 1:
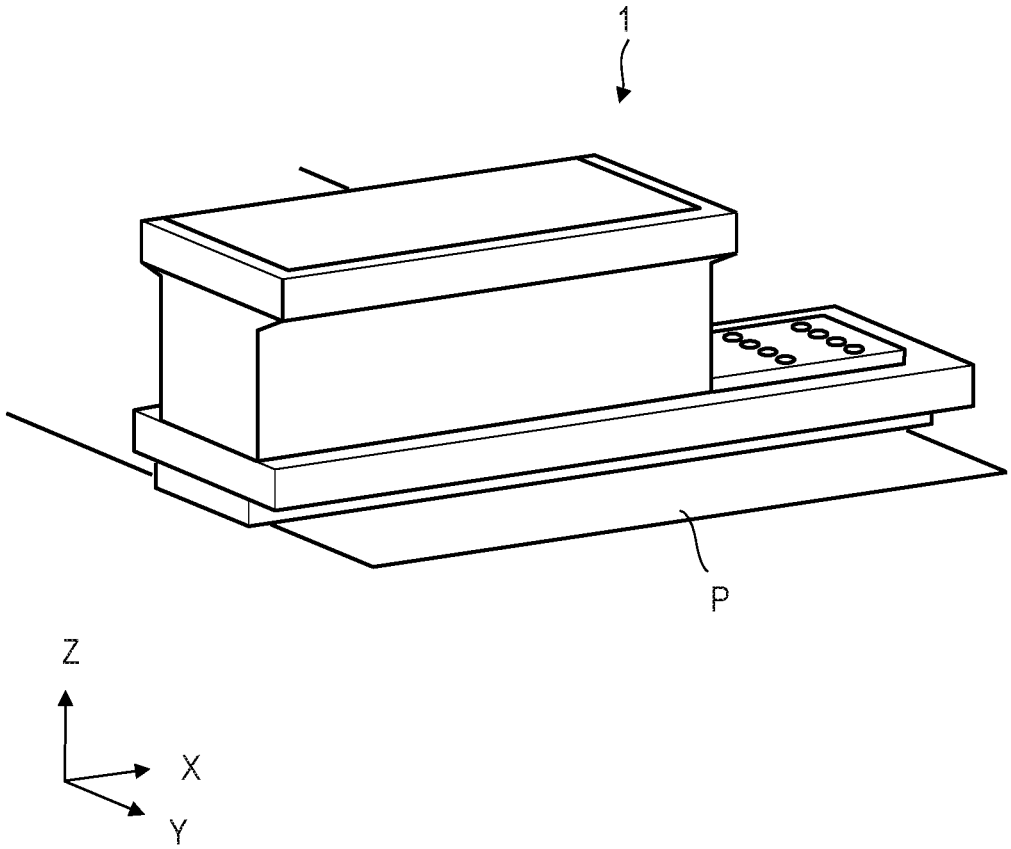
FIG. 1 is a conceptual diagram of a liquid ejection head according to a first embodiment of the present invention.

FIG. 1 is a schematic perspective view of a liquid ejection head 1 according to a first embodiment of the present invention. The printer (liquid ejection apparatus) includes a conveyance unit (not shown) for conveying a recording medium P, and a page-wide type (line type) liquid ejection head 1 extending in a direction orthogonal to the conveyance direction of the recording medium P. While conveying a plurality of recording media P continuously or intermittently, the printer performs simultaneously recording on the entire area of the width direction of the recording media P in one pass, that is, without moving the liquid ejection head 1 in the width direction of the recording media P. The recording medium P is not limited to cut paper, and may be continuous roll paper. The printer has ink tanks of four colors of CMYK (cyan, magenta, yellow, black), and can perform full color printing.

Figure 2A:
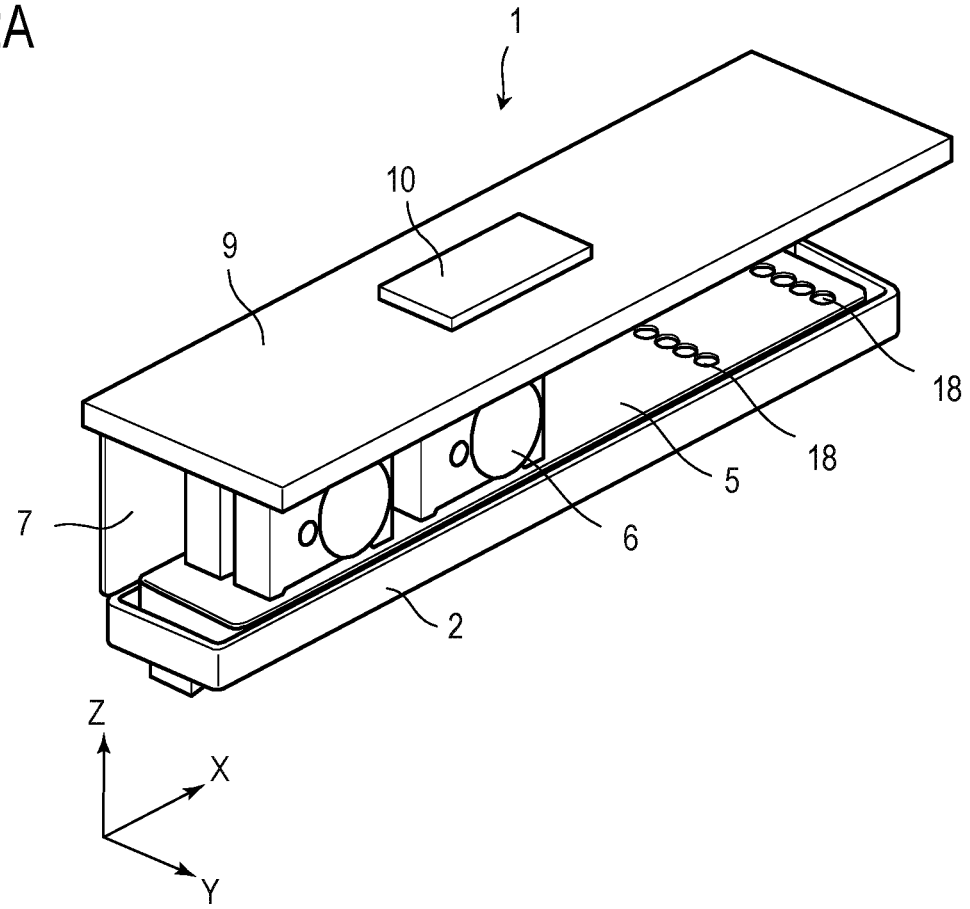
FIG. 2A is a conceptual perspective view showing the internal configuration of the liquid ejection head of FIG. 1.
Figure 2B:
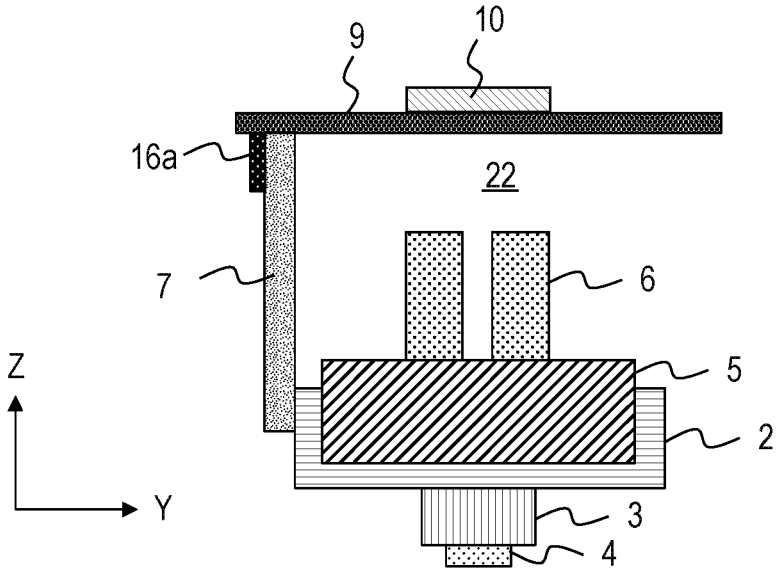
FIG. 2B is a schematic sectional view of the liquid ejection head 1 in the YZ plane of FIG. 2A.
Figure 3:
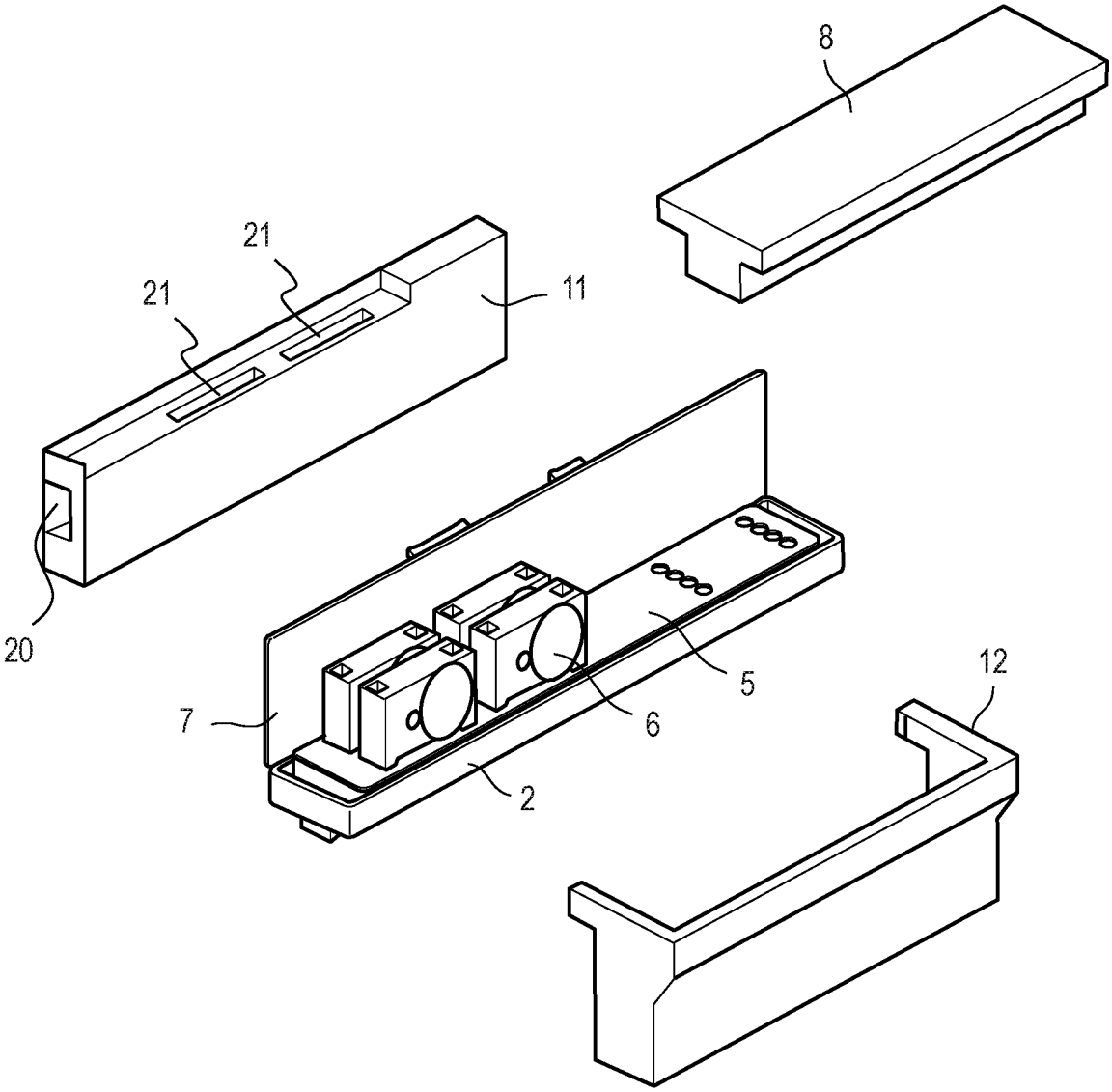
FIG. 3 is an exploded perspective view of the liquid ejection head of FIG. 1.

FIG. 2A is a conceptual perspective view showing the internal configuration of the liquid ejection head 1, and in order to facilitate understanding of the internal structure, the illustration of first and second housings 11 and 14, and a head cover 12 is omitted. FIG. 2B is a schematic sectional view of the liquid ejection head 1 in the YZ plane of FIG. 2A. FIG. 3 is an exploded perspective view of the liquid ejection head 1 of FIG. 1.

Figure 4A:
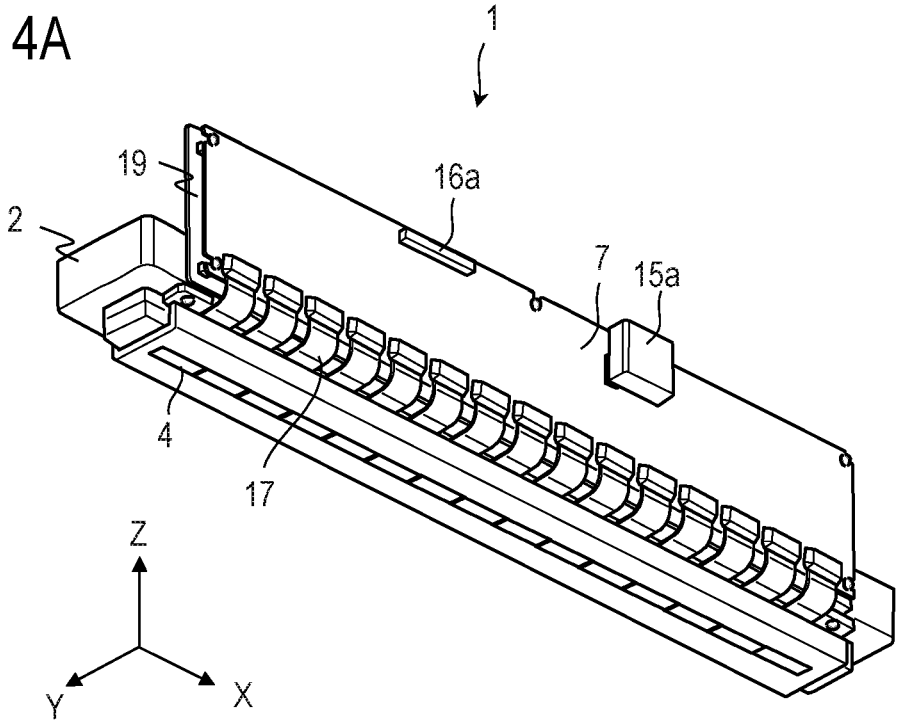
FIG. 4A is a perspective view of the liquid ejection head of FIG. 1.
Figure 4B:
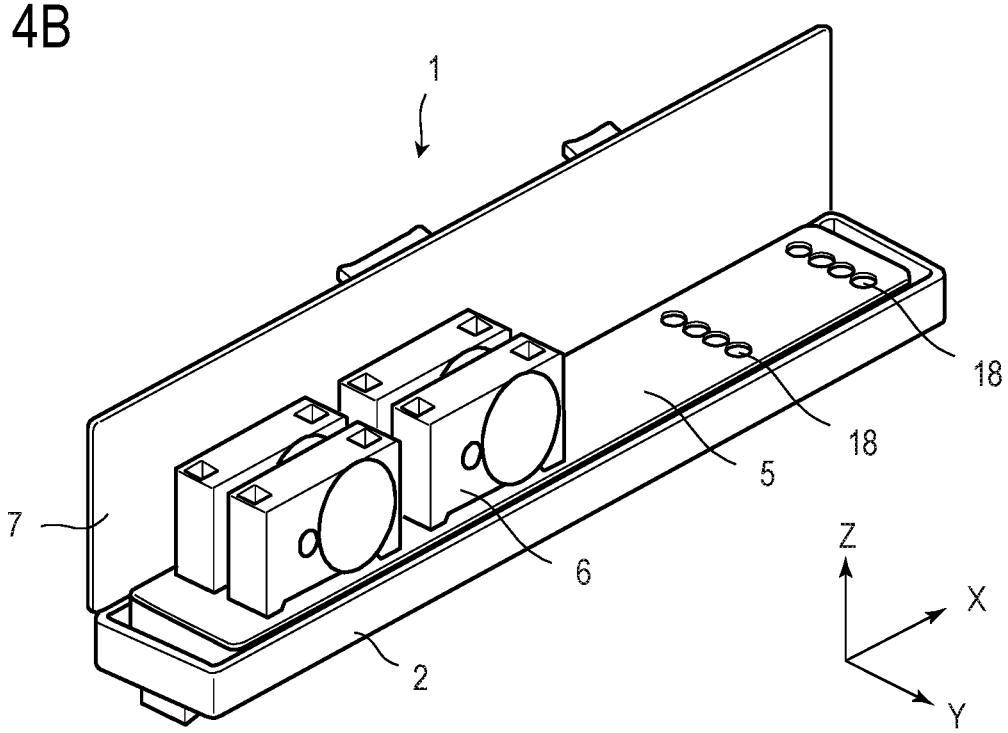
FIG. 4B is a perspective view of the liquid ejection head of FIG. 1.
Figure 15:
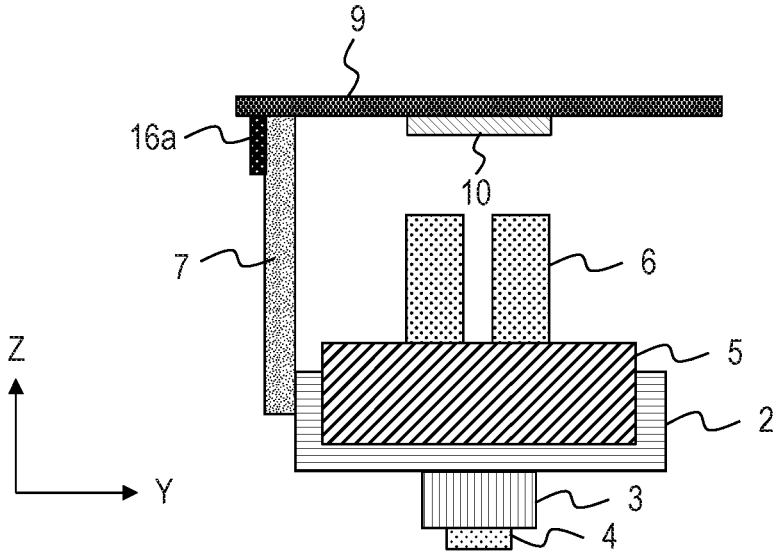
FIG. 15 is a conceptual diagram of a liquid ejection head according to a twelfth embodiment of the present invention.

The liquid ejection head 1 includes a liquid supplying unit 5, a support member 2, and a liquid ejection unit 3. The liquid supplying unit 5 is connected to the printer main body, and supplies the ink stored in the ink tank (not shown) of the printer main body to the liquid ejection unit 3. The liquid ejection unit 3 has an element substrate 4 including an energy-generating element (not shown). Although not shown, the element substrate 4 includes a pressure chamber in which ink bubbles, an ejection orifice which communicates with the pressure chamber and from which the ink is ejected, an ink supply path through which the ink is supplied to the pressure chamber, and an ink collection path through which the ink is collected from the pressure chamber. As shown in FIGS. 4A and 4B, 15 element substrates 4 are arranged in a row in the X direction along one straight line to constitute one line head (an arrangement method where a plurality of element substrates 4 is arranged in such a linear manner may be referred to as an in-line arrangement). The support member 2 is a metallic casing that supports the liquid supplying unit 5 and the liquid ejection unit 3. On the upper surface of the liquid supplying unit 5, eight ink connection portions 18 are provided. The eight ink connection portions 18 are connected to respective common ink supply paths and respective common ink collection paths (described later) for each color ink.

The liquid ejection head 1 includes a first electric wiring board 7 for supplying driving power and an electric signal to the energy-generating element. FIGS. 4A and 4B are perspective views of the liquid ejection head 1 (the illustration of a second electric wiring board 9 described below is omitted). FIG. 4A shows the surface on which a first power terminal 15*a* and a first signal terminal 16*a* of the first electric wiring board 7 are mounted, and FIG. 4B shows the back surface thereof. The first electric wiring board 7 connects a control unit and a power supply unit (not shown) provided in the printer main body to the element substrate 4, and supplies driving power and an electric signal (a control signal) to the energy-generating element. The first electric wiring board 7 is supported by the support member 2 via a support plate 19, and is also connected to the element substrate 4 via an electric wiring member 17 such as a flexible wiring board (FPC). The first electric wiring board 7 is arranged so that the distance between the first electric wiring board 7 and the element substrate 4 in the Y direction is as small as possible. This can shorten the length of the electric wiring member 17.

The first electric wiring board 7 includes the first power terminal 15*a* for supplying driving power from the printer main body to the second electric wiring board 9 described later and the first signal terminal 16*a* for supplying an electric signal from the printer main body to an integrated circuit element 10. The first electric wiring board 7 further includes an inlet terminal (not shown) for receiving driving power and signal power from the printer main body. The inlet terminal is electrically connected to the first power terminal 15*a* and the first signal terminal 16*a* via internal wiring (not shown) of the first electric wiring board 7. The first electric wiring board 7 is accommodated in and supported by a first housing 11. The first housing 11 includes a first connection opening 20 in which the inlet terminal is exposed, and a second connection opening 21 in which the first power terminal 15*a* and the first signal terminal 16*a* are exposed.

Figure 5:
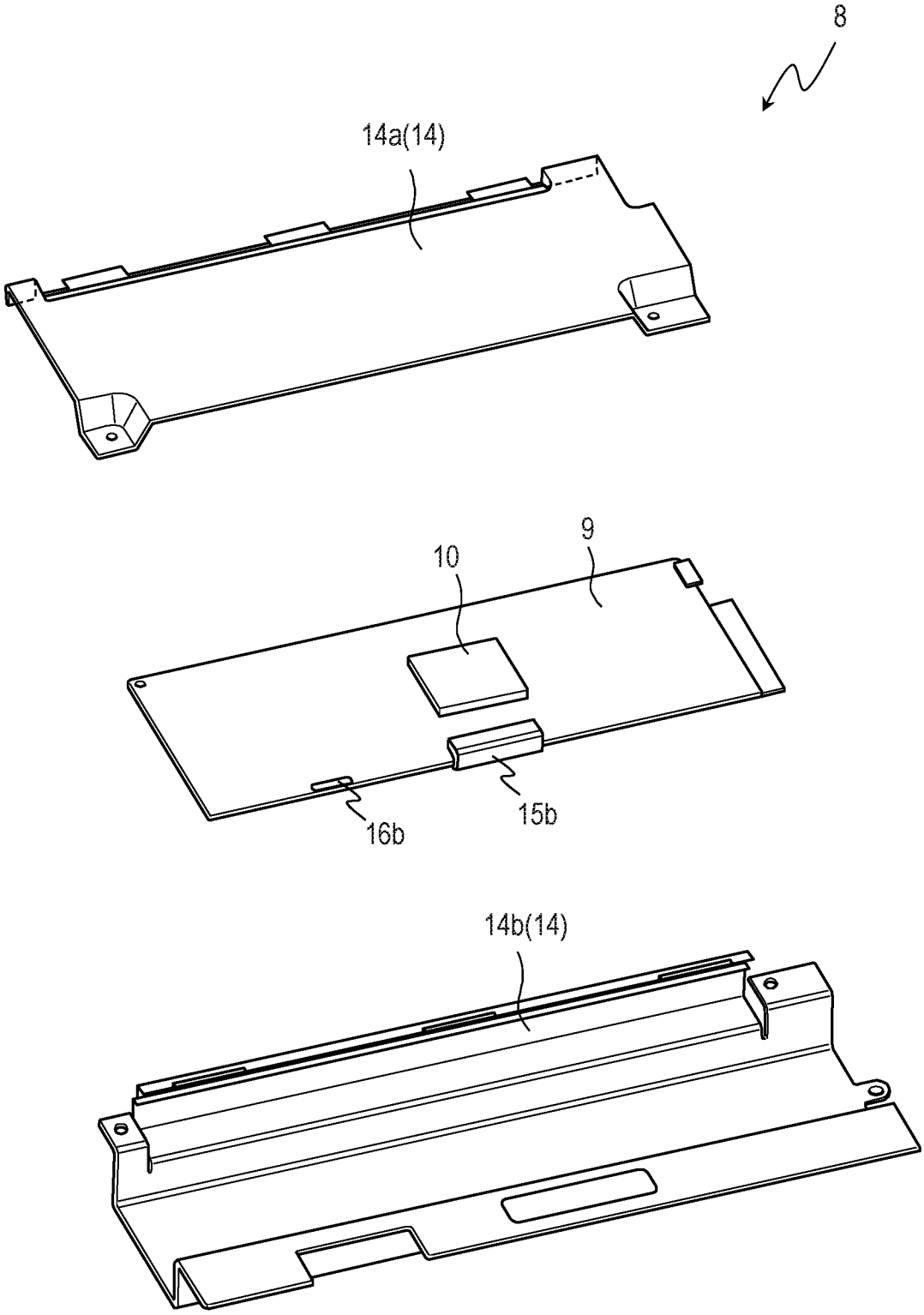
FIG. 5 is an exploded perspective view of an integrated circuit board unit of the liquid ejection head of FIG. 1.

The liquid ejection head 1 has an integrated circuit board unit 8. One end of the integrated circuit board unit 8 is supported by the first electric wiring board 7 and the other end thereof is supported by the head cover 12 to be described later. FIG. 5 is an exploded perspective view of the integrated circuit board unit 8. The integrated circuit board unit 8 includes the second electric wiring board 9, the integrated circuit element 10 which is mounted on the second electric wiring board 9 and processes an electric signal, and a second housing 14 for accommodating and supporting the second electric wiring board 9 and the integrated circuit element 10. The integrated circuit element 10 is provided on the upper surface of the second electric wiring board 9, that is, on a surface of the second electric wiring board 9 where the surface is opposite to a surface facing the element substrate 4. Therefore, it is possible to reduce the influence of radiant heat generated from the integrated circuit element 10 on the element substrate 4. The second housing 14 includes first and second protective metal plates 14*a* and 14*b* made of aluminum. The first protective metal plate 14*a* and the second protective metal plate 14*b* respectively cover one surface and the other surface of the second electric wiring board 9. The second electric wiring board 9 includes a second power terminal 15*b* for receiving driving power from the first power terminal 15*a* and a second signal terminal 16*b* for receiving an electric signal from the first signal terminal 16*a*. The second power terminal 15*b* and the second signal terminal 16*b* are connected to the integrated circuit element 10 via internal wiring (not shown) of the second electric wiring board 9.

The second electric wiring board 9 is electrically and physically connected to the first electric wiring board 7. The first electric wiring board 7 and the second electric wiring board 9 are connected so as to be substantially orthogonal to each other. The angle formed between the first electric wiring board 7 and the second electric wiring board 9 is not limited, and may be any degrees other than 0 degrees. In other words, the first electric wiring board 7 and the second electric wiring board 9 can be arranged in non-parallel directions to each other. The first signal terminal 16*a* of the first electric wiring board 7 and the second signal terminal 16*b* of the second electric wiring board 9 are connected by a connector. Specifically, the first signal terminal 16*a* has a male shape, and the second signal terminal 16*b* has a female shape. As a result, the substrates can be electrically connected directly to each other without using a cable. The first power terminal 15*a* and the second power terminal 15*b* are connected by a cable because the power to be transmitted is large. As described above, the driving power passes through the inlet terminal exposed to the first connection opening 20, the internal wiring of the first electric wiring board 7, and the first power terminal 15*a* exposed at the second connection opening 21, and is supplied to the second power terminal 15*b* of the second electric wiring board 9. The electric signal passes through the inlet terminal exposed to the first connection opening 20, the internal wiring of the first electric wiring board 7, and the first signal terminal 16*a* exposed at the second connection opening 21, and is supplied to the second signal terminal 16*b* of the second electric wiring board 9. The driving power and the electric signal supplied from the second power terminal 15*b* and the second signal terminal 16*b* to the second electric wiring board 9 are supplied through the internal wiring of the second electric wiring board 9 to the integrated circuit element 10. The integrated circuit element 10 is driven by the driving power. The electric signal processed by the integrated circuit element 10 is supplied to the element substrate 4 through the first electric wiring board 7. In this way, the first signal terminal 16*a* supplies and receives an electric signal, that is, supplies the electric signal to the second signal terminal 16*b* and receives the processed electric signal from the second signal terminal 16*b*. The second signal terminal 16*b* supplies and receives an electric signal, that is, receives an electric signal from the first signal terminal 16*a* and supplies the processed electric signal to the first signal terminal 16*a*.

The liquid ejection head 1 includes the liquid supplying unit 5 fluidly connected to the plurality of element substrates 4. The liquid supplying unit 5 is formed by resin molding. Inside the liquid supplying unit 5, a common ink supply path and a common ink collection path are provided for each color ink. The common ink supply paths and the common ink collection paths are connected to the ink supply system of the printer main body via the ink connection portions 18, and also connected to the element substrate 4 of the liquid ejection unit 3. The ink supplied to the element substrate 4 is circulated between the element substrate 4 and the outside (printer main body) thereof. As a result, since the ink flows at any time without remaining in the pressure chamber even when the ink is not ejected from the ejection orifice, it is possible to suppress an increase in viscosity of the ink. In the liquid ejection head that circulates the liquid in the pressure chamber having the energy-generating element therein as in the present embodiment, the heat of the integrated circuit element 10 is likely to affect the entire liquid ejection head. Thus, the present invention is more effectively applied.

A pressure control mechanism 6 for making the pressure of the common ink collection paths lower than the pressure of the common ink supply paths is provided on the liquid supplying unit 5. The pressure control mechanism 6 adjusts the pressures of the common ink supply paths and the common ink collection paths so that the negative pressure of the common ink collection path is larger than the negative pressure of the common ink supply path. Due to the pressure difference caused by the difference in the negative pressures, ink is supplied from the common ink supply paths to each pressure chamber, and the ink that has not been ejected is collected in the common ink collection paths. That is, the ink is supplied from the ink tank mounted on the printer main body to the liquid supplying unit 5 via the ink connection portions 18, adjusted to an appropriate pressure by the pressure control mechanism 6, and supplied to the element substrate 4.

The liquid supplying unit 5 and the pressure control mechanism 6 are covered and protected by the head cover 12. The head cover 12 is provided so as to cover a surface of the first electric wiring board 7 where the first power terminal 15*a* and the first signal terminal 16*a* are not provided on the surface.

In the liquid ejection head 1 of the present embodiment, the plurality of element substrates 4 and the second electric wiring board 9 are arranged substantially in parallel with the YX plane. A space 22 is provided between the plurality of element substrates 4 and the second electric wiring board 9, and the liquid supplying unit 5 and the pressure control mechanism 6 are arranged in this space 22. The integrated circuit element 10 is mounted on the second electric wiring board 9. The element substrates 4, the first electric wiring board 7, and the second electric wiring board 9 form part of a heat conduction path made of a solid medium which is continuously connected from the integrated circuit element 10 to the element substrate 4. The heat conduction path in this embodiment is a path composed of the element substrate 4, the liquid ejection unit 3, the support member 2, the first electric wiring board 7, and the second electric wiring board 9. On this path, the first electric wiring board 7 is positioned between the element substrates 4 and the second electric wiring board 9. In addition, the second electric wiring board 9 is further away from the element substrate 4 than the first electric wiring board 7. Here, being further away from the element substrate 4 is to have a larger linear distance from the element substrate 4. That is, the shortest distance between the plurality of element substrates 4 and the second electric wiring board 9 is longer than the shortest distance between the plurality of element substrates 4 and the first electric wiring board 7.

Figure 16A:
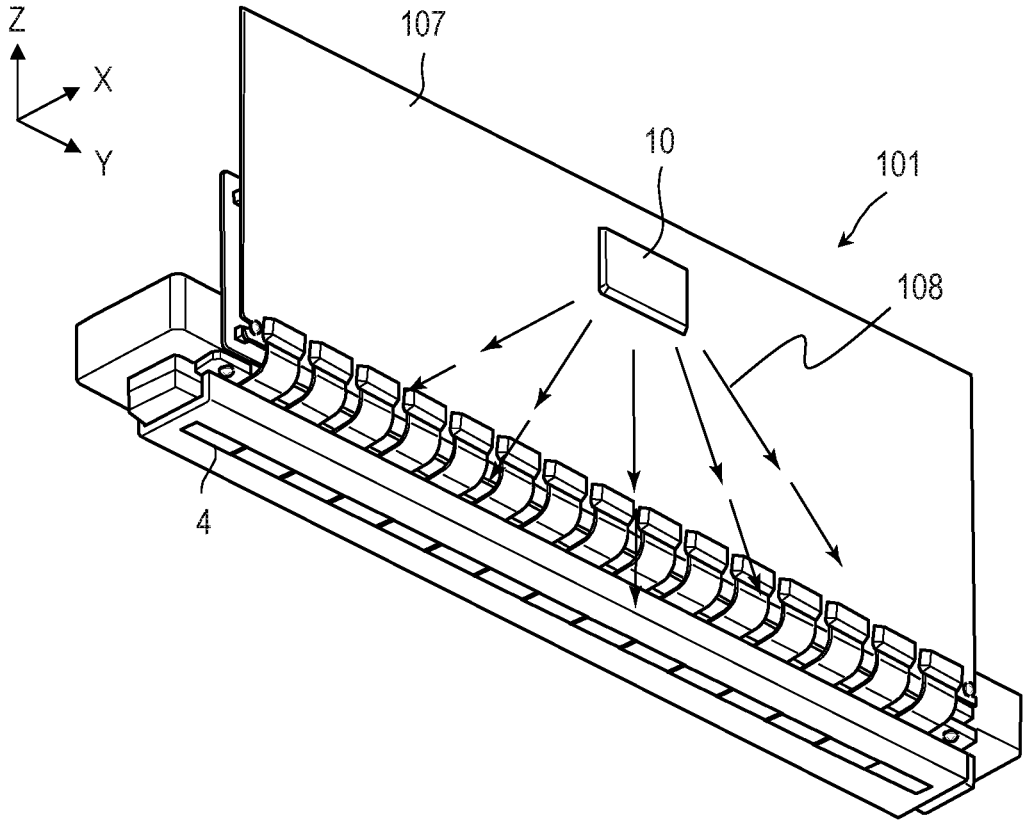
FIG. 16A is a conceptual diagram of a liquid ejection head according to a comparative example.
Figure 16B:
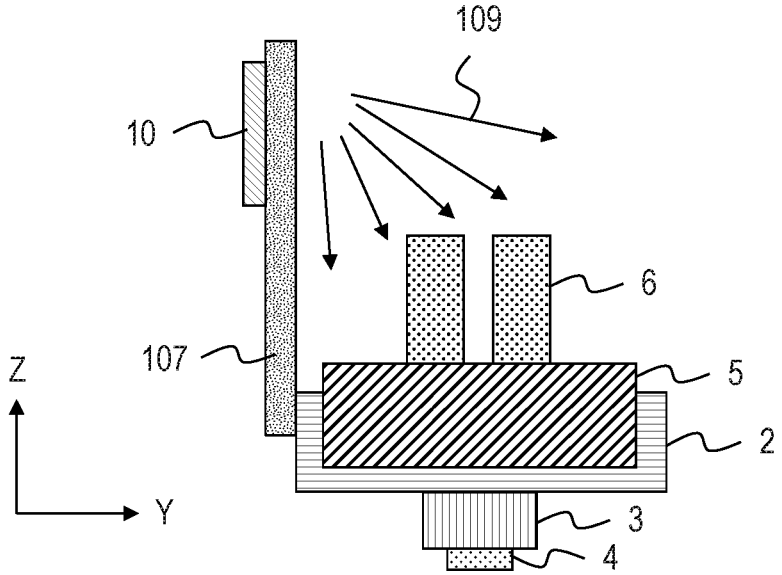
FIG. 16B is a schematic sectional view of the liquid discharge head in the YZ plane of FIG. 16A.

Next, the effect of the liquid ejection head 1 described above will be described in comparison with a comparative example. FIG. 16A is a schematic perspective view of the liquid ejection head 101 of the comparative example, and FIG. 16B is a schematic sectional view of the liquid ejection head 101 in the YZ plane of FIG. 16A. The integrated circuit element 10 is provided on an electric wiring board 107 corresponding to the above-described first electric wiring board 7. That is, the electric wiring board corresponding to the second electric wiring board 9 is not provided in the comparative example. The pressure control mechanism 6 is provided on the liquid supplying unit 5. The integrated circuit element 10 is provided at the center of the electric wiring board in the Y direction. As a result, the integrated circuit element 10 is closest to the element substrate 4 located at the center of a row of the element substrates. Heat from the integrated circuit element 10 is transferred to the element substrate 4 by heat conduction and heat radiation (radiation). Heat conduction is a phenomenon in which heat from the integrated circuit element 10 is transferred to the element substrate 4 through a solid medium such as an electric wiring board (reference numeral 108). Heat radiation is a phenomenon in which heat from the integrated circuit element 10 propagates in the air as electromagnetic waves and is transferred to the element substrate 4 (reference numeral 109). In both heat conduction and heat radiation, the element substrate 4 located at the center of a row of the element substrates, which has the shortest heat transfer path from the integrated circuit element 10, has the highest temperature, and the element substrate 4 which is located away from the integrated circuit element 10 has a low temperature.

Printing was carried out with a predetermined printing pattern (halftone printing) and the unevenness of the printing density in the width direction (Y direction) of the recording medium P was observed. As a result, the printing was dark at the central portion of the liquid ejection head 101 and thin at the end portion thereof. This is probably because the temperature variation in the Y direction occurs in a row of the element substrates due to the influence of heat of the integrated circuit element 10 and the viscosity of the ejected ink decreases on the central element substrate 4, leading to the increased ejection amount. Such variations in print densities may affect the quality of printing. One way to make the temperature distribution moderate is to install the integrated circuit element 10 in the printer main body. In that case, however, the number of wires between the liquid ejection head 101 and the printer main body increases. This increasing not only complicates the configuration of the connecting portion but also complicates the replacement of the element substrate 4.

Similar printing was performed with the liquid ejection head 1 of the present embodiment. In this case, the unevenness in the printing density in the width direction of the recording medium P was reduced compared with the comparative example. The reasons are as follows. First, it is considered that in the present embodiment, since the distance between the integrated circuit element 10 and the element substrate 4 along the path formed of the solid medium is increased, the amount of heat input to the element substrate 4 by heat conduction along a path formed of a solid medium is reduced. That is, it is considered that since the distance of the heat transfer path along the path formed by the solid medium between the integrated circuit element 10 and the element substrate 4 is increased, the amount of heat transferred from the second electric wiring board 9 through the first electric wiring board 7 to the element substrate 4 is reduced. Next, it is considered that since the first electric wiring board 7 and the second electric wiring board 9 are connected merely by a connector or the like, the amount of heat transferred from the second electric wiring board 9 to the first electric wiring board 7 is restricted. Next, it is considered that since the linear distance between the integrated circuit element 10 and the liquid supplying unit 5 is increased, the amount of heat input to the element substrate 4 by heat radiation is reduced. It should be noted that probably the heat transfer between the second electric wiring board 9 and the liquid supplying unit 5 is made through heat conduction in which an air layer in the space 22 between the second electric wiring board 9 and the liquid supplying unit 5 acts as a medium. However, since the air layer acts as a heat insulating layer, and the distance (the thickness of the air layer) between the second electric wiring board 9 and the liquid supplying unit 5 is ensured, it is considered that the heat transfer in this form is suppressed. Further, it is also probable that the radiant heat from the integrated circuit element 10 be diffused by the second housing 14 in which the integrated circuit element 10 is accommodated, and the heat dissipation to the plurality of element substrates 4 be homogenized. It is considered that the liquid supplying unit 5 and the pressure control mechanism 6 between the second electric wiring board 9 and the liquid supplying unit 5 also contribute to heat shielding against the element substrate 4.

Next, in the present embodiment, since the first electric wiring board 7 and the second electric wiring board 9 are arranged perpendicular to each other, the dimension of the liquid ejection head 1 in the height direction Z is reduced, and it is possible to suppress the increase in size of the liquid ejection head 1. Since the first signal terminal 16*a* and the second signal terminal 16*b* are connected by a connector, it is easy to arrange the first electric wiring board 7 and the second electric wiring board 9 at the right angle to each other. In particular, in the page-wide type liquid ejection head 1 that ejects ink of a plurality of colors, it is effective to arrange the first electric wiring board 7 and the second electric wiring board 9 at the right angle to each other. This arrangement is effective when considering that in the liquid ejection head 1 of this type, the liquid supplying unit 5 needs a certain dimension in the Y direction. That is, even when the second electric wiring board 9 is arranged above the liquid supplying unit 5, the dimension of the second electric wiring board 9 in the Y direction falls within the range of the dimension of the liquid supplying unit 5 in the Y direction, and an increase in the dimension of the liquid ejection head 1 in the Y direction can be avoided.

Next, another embodiment will be described. Hereinafter, the differences from the first embodiment will be mainly described, and the configurations, effects and the like which are not particularly described are the same as those in the first embodiment. While the first electric wiring board 7 is arranged on either of the side face or the top face of the support member 2 according to the embodiment, it may be arranged on both of the side face and the top face of the support member 2 if possible. Also, in some embodiments, the pressure control mechanism 6 is not installed. The pressure control mechanism 6 may be installed in the printer main body. Therefore, in any of the embodiments, the pressure control mechanism 6 may or may not be installed in the liquid ejection head.

Second Embodiment

The liquid ejection head 1 of the present embodiment is the same as the first embodiment except that the ink does not circulate. In the present embodiment, common ink supply paths are connected to respective both sides of the pressure chamber, and the ink connection portions 18 are connected to respective common ink supply paths. That is, the common ink collection paths of the first embodiment are used as the second common ink supply paths. Alternatively, the common ink collection paths are not provided and the deep side of the pressure chamber in the ink supply direction can be dead-ended. In this case, four of the eight ink connection portions 18 are unnecessary. In either case, the pressure control mechanism 6 may or may not be provided.

Third Embodiment

Figure 6:
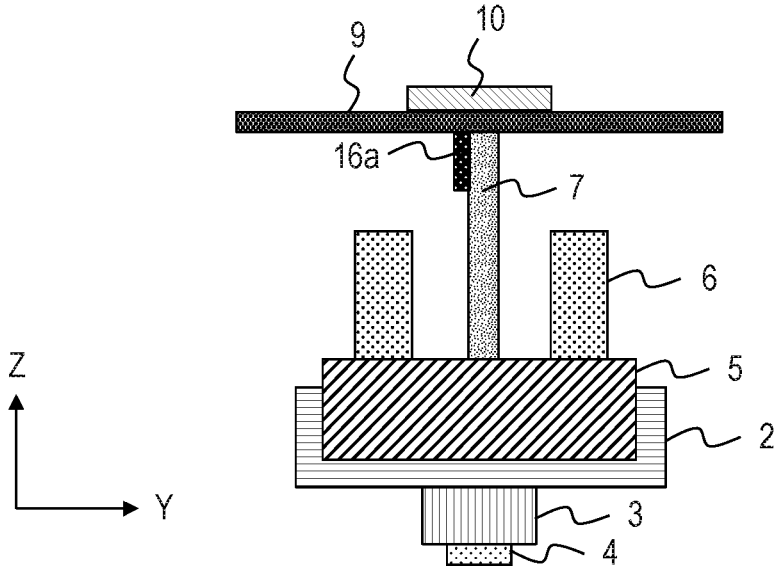
FIG. 6 is a conceptual diagram of a liquid ejection head according to a third embodiment of the present invention.

FIG. 6 is a schematic sectional view of the liquid ejection head 1 according to a third embodiment of the present invention. The first electric wiring board 7 is arranged just above the element substrate 4. The second electric wiring board 9 is arranged substantially perpendicular to the first electric wiring board 7 and is connected to the first electric wiring board 7 at a substantially central portion of the second electric wiring board 9 in the Y direction. The integrated circuit element 10 is provided at a substantially central portion of the second electric wiring board 9 in the Y direction, that is, on a surface of the second electric wiring board 9 where the surface is opposite to a connection part between the second electric wiring board 9 and the first electric wiring board 7. The pressure control mechanisms 6 are arranged away from each other on both sides of the first electric wiring board 7 in the Y direction. In the present embodiment, since the electric wiring member 17 connecting the element substrate 4 and the first electric wiring board 7 can be drawn on both sides of the first electric wiring board 7 in the Y direction, the degree of freedom of wiring increases. This embodiment is also effective when it is necessary to make the liquid ejection head 1 compact in the Y direction. For example, as in the first embodiment, when the first electric wiring board 7 is arranged on the side face of the support member 2 and the first housing 11 is provided, the dimension in the Y direction is increased. On the other hand, in the present embodiment, the sizes of the first electric wiring board 7 and the first housing 11 in the Y direction do not affect the dimension of the liquid ejection head 1 in the Y direction.

When printing was performed by ejected ink in a similar way in the first embodiment, the unevenness in the printing density in the width direction of the recording medium P was reduced compared with the comparative example. However, compared with the first embodiment 1, since the heat transmission path in the second electric wiring board 9 is short, the first embodiment is more advantageous in terms of suppressing the influence of heat.

Fourth Embodiment

Figure 7A:
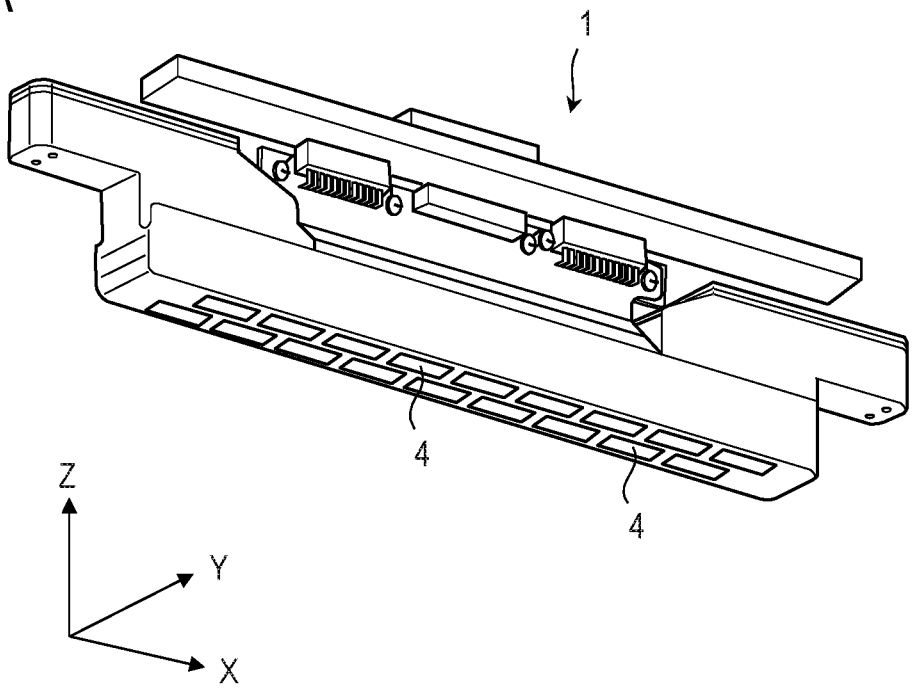
FIG. 7A is a conceptual diagram of a liquid ejection head according to a fourth embodiment of the present invention.
Figure 7B:
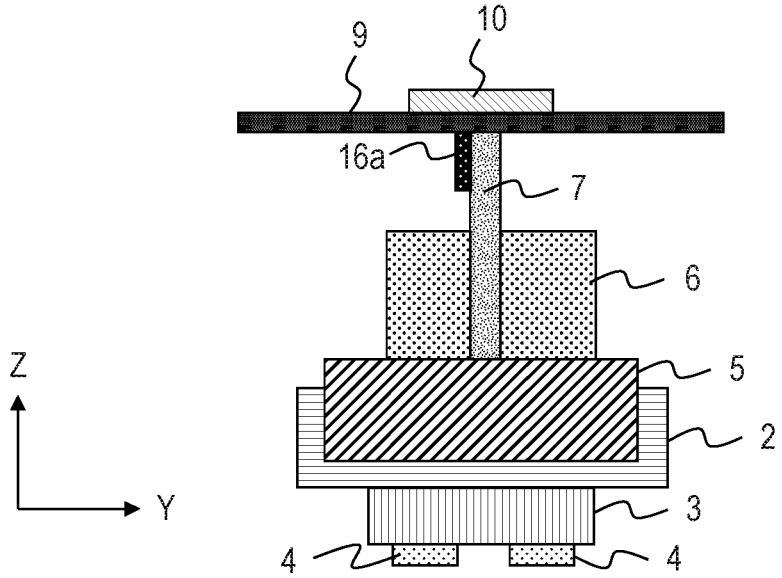
FIG. 7B is a schematic sectional view of the liquid ejection head 1 in the YZ plane of FIG. 7A.

FIG. 7A is a schematic perspective view of the liquid ejection head 1 according a fourth embodiment of the present invention, and FIG. 7B is a schematic sectional view of the liquid ejection head 1 in the YZ plane of FIG. 7A. Unlike the first embodiment, the present embodiment has the element substrate 4 arranged in a staggered pattern along a plurality of (two in this case) straight lines. In the present embodiment, since the printing range of the liquid ejection head 1 in the Y direction is increased, higher speed printing can be performed. Further, in the present embodiment, as in the third embodiment, since the second electric wiring board 9 is connected to the first electric wiring board 7 at the central portion of the second electric wiring board 9 in the Y direction, the effects similar to those in the third embodiment can be obtained.

Fifth Embodiment

Figure 8:
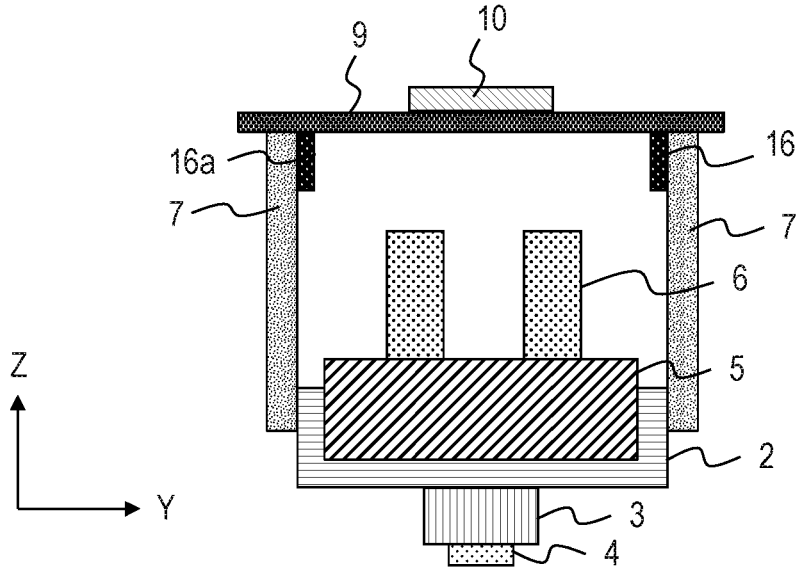
FIG. 8 is a conceptual diagram of a liquid ejection head according to a fifth embodiment of the present invention.

FIG. 8 is a schematic sectional view of the liquid ejection head 1 according to a fifth embodiment of the present invention. In the present embodiment, a plurality of (two in this case) first electric wiring boards 7 are provided, and the second electric wiring board 9 is connected to each of the plurality of first electric wiring boards 7. The first electric wiring boards 7 are arranged in parallel to each other, and the second electric wiring board 9 is connected to the first electric wiring boards 7 so as to form a substantially right angle relative to the first electric wiring boards 7. The two first electric wiring boards 7 are each connected to the support member 2 at the end of the support member 2 in the Y direction. The pressure control mechanism 6 is arranged between the two first electric wiring boards 7. In the present embodiment, since the second electric wiring board 9 is held by the two first electric wiring boards 7, the connection reliability of the second electric wiring board 9 is improved. In addition, since the pressure control mechanism 6 is surrounded and protected by the plurality of first electric wiring boards 7 and the second electric wiring board 9, the head cover 12 is unnecessary, which leads to cost reduction in the liquid ejection head 1.

Sixth Embodiment

Figure 9:
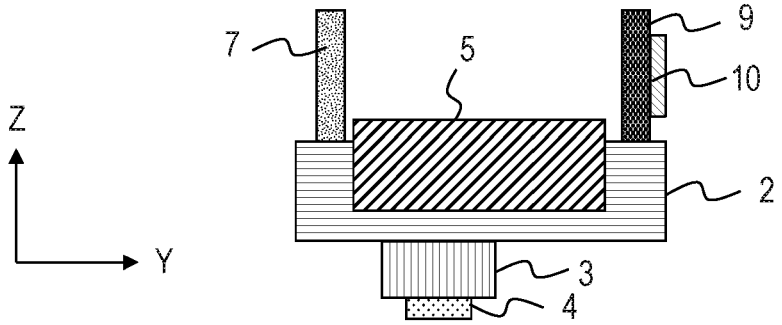
FIG. 9 is a conceptual diagram of a liquid ejection head according to a sixth embodiment of the present invention.

FIG. 9 is a schematic sectional view of the liquid ejection head 1 according to a sixth embodiment of the present invention. In the present embodiment, the first electric wiring board 7 is connected to one end of the support member 2 in the Y direction, and the second electric wiring board 9 is connected to the other end of the support member 2. That is, the element substrate 4, the first electric wiring board 7, and the second electric wiring board 9 are arranged along the path of the solid medium such that the element substrate 4 is positioned between the first electric wiring board 7 and the second electric wiring board 9. The first electric wiring board 7 and the second electric wiring board 9 are electrically connected to each other via the support member 2. The element substrate 4 is arranged to be shifted on the first electric wiring board 7 side from the center in the Y direction of the support member 2, and the distance from the element substrate 4 to the second electric wiring board 9 is longer than the distance from the element substrate 4 to the first electric wiring board 7. Heat from the integrated circuit element 10 is transferred from the second electric wiring board 9 to the element substrate 4 through the support member 2. Since the element substrate 4 is arranged to be shifted on the first electric wiring board 7 side, the influence of heat is reduced.

Seventh Embodiment

Figure 10:
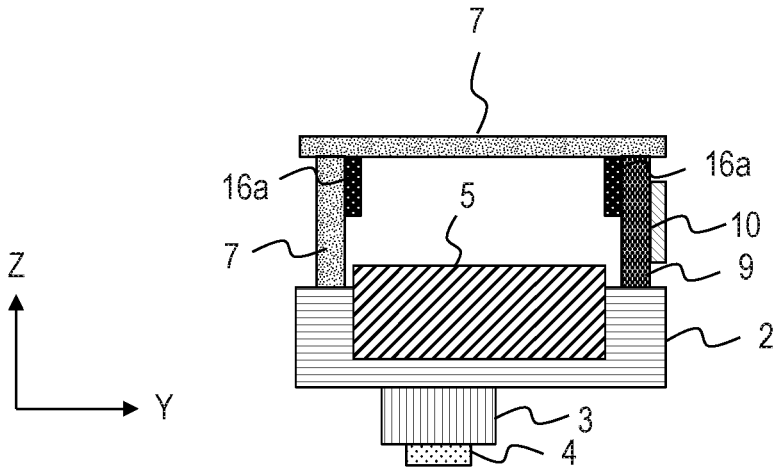
FIG. 10 is a conceptual diagram of a liquid ejection head according to a seventh embodiment of the present invention.

FIG. 10 is a schematic sectional view of the liquid ejection head 1 according to a seventh embodiment of the present invention. In this embodiment, a plurality of (two in this case) first electric wiring boards 7 are connected to each other in series, and the second electric wiring board 9 is connected to one of the first electric wiring boards 7 where the one of the first electric wiring boards 7 is located further away from the element substrate 4. Since the second electric wiring board 9 is not fixed to the support member 2, heat conduction from the second electric wiring board 9 to the support member 2 does not occur. In a case where the support member 2 is made of a highly heat-insulating material such as resin, the second electric wiring board 9 may be fixed to the support member 2. Alternatively, when the support member 2 is made of metal, the second housing 14 may be formed of a highly heat-insulating material and the second electric wiring board 9 may be fixed to the support member 2 via the second housing 14. As in the sixth embodiment, since the element substrate 4 is arranged to be shifted on the first electric wiring board 7 side from the center of the support member 2 in the Y direction, the influence of heat radiation is also reduced. Although not shown in the drawing, the element substrate 4 may be arranged to be shifted on the second electric wiring board 9 side from the center of the support member 2 in the Y direction. In this case, although the influence of heat radiation becomes stronger, the influence of heat conduction is further reduced.

Eighth Embodiment

Figure 11A:
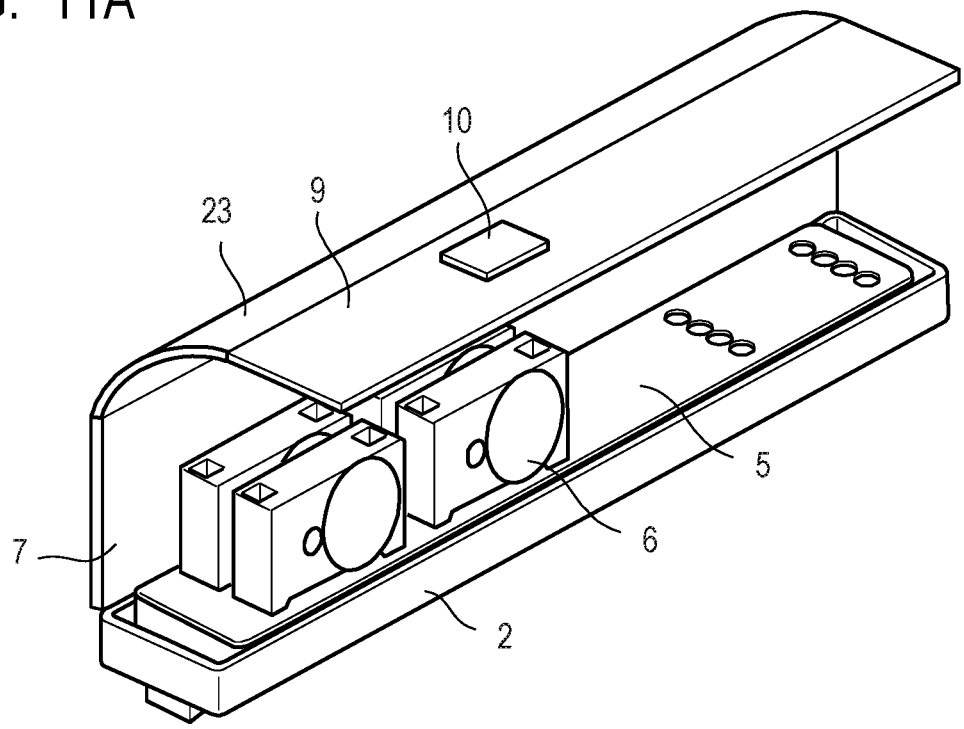
FIG. 11A is a conceptual diagram of a liquid ejection head according to an eighth embodiment of the present invention.
Figure 11B:
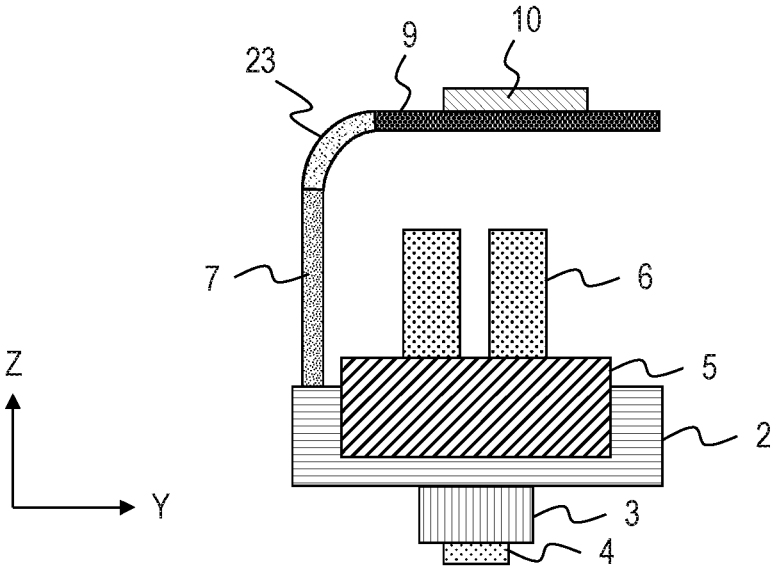
FIG. 11B is a schematic sectional view of the liquid discharge head in the YZ plane of FIG. 11A.

FIG. 11A is a schematic perspective view of the liquid ejection head 1 of the eighth embodiment, and FIG. 11B is a schematic sectional view of the liquid ejection head 1 in the YZ plane of FIG. 11A. In the present embodiment, the first electric wiring board 7 and the second electric wiring board 9 are connected by a curved electric wiring member 23. That is, in each of the above-described embodiments, the first electric wiring board 7 and the second electric wiring board 9 are separated (removable), whereas in the present embodiment, the first electric wiring board 7 and the second electric wiring board 9 are fixedly joined to each other. As the electric wiring member 23, a flexible substrate or a flexible tape can be used. The second electric wiring board 9 is arranged substantially perpendicular to the first electric wiring board 7 due to stiffness of the electric wiring member 23 and is arranged at a position facing the element substrate 4. One end of the second electric wiring board 9 where the other end of the second electric wiring board 9 is connected to the electric wiring member 23 is free. The one end may be held by the head cover 12. The electric wiring member 23 may be a member having a lower heat conductivity than the first and second electric wiring boards 7 and 9, so that the influence of heat conduction can be reduced.

Ninth Embodiment

Figure 12:
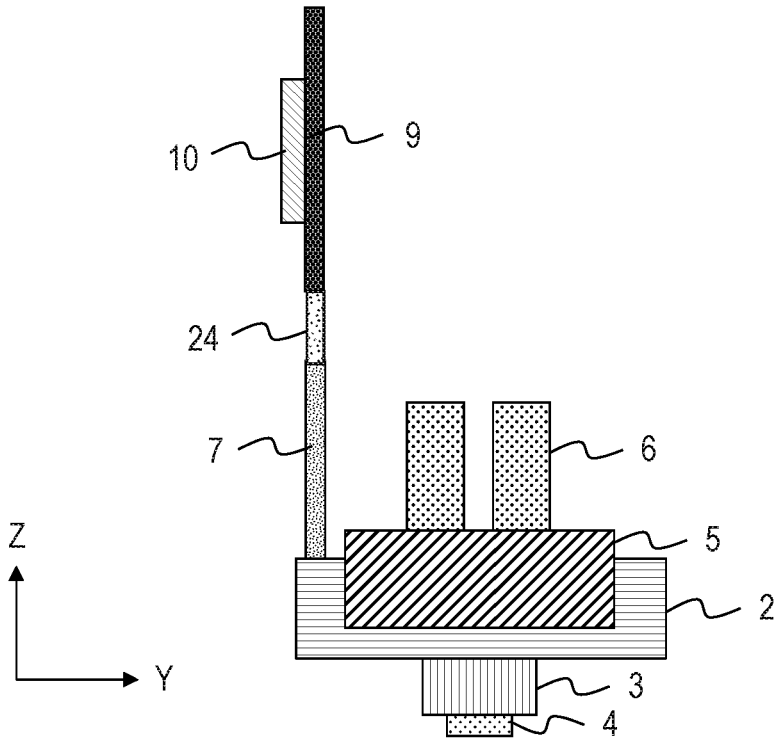
FIG. 12 is a conceptual diagram of a liquid ejection head according to a ninth embodiment of the present invention.

FIG. 12 is a schematic sectional view of the liquid ejection head 1 according to a ninth embodiment of the present invention. In the present embodiment, as in the eighth embodiment, the first electric wiring board 7 and the second electric wiring board 9 are connected through an electric wiring member 24. The electric wiring member 24 extends in a planar shape such that the first electric wiring board 7 and the second electric wiring board 9 are positioned on the same plane. The first electric wiring board 7 and the second electric wiring board 9 extend in a direction substantially orthogonal to the element substrate 4. In the present embodiment, since it is easy to ensure the distance between the integrated circuit element 10 and the element substrate 4, it is possible to reduce the influence of radiant heat, in particular. The second electric wiring board 9 may be accommodated in and supported by another member.

Tenth Embodiment

Figure 13:
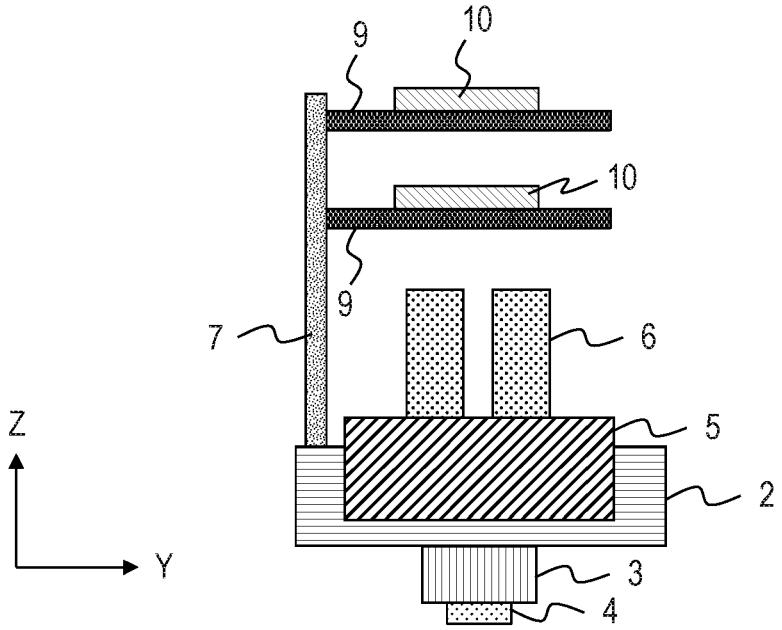
FIG. 13 is a conceptual diagram of a liquid ejection head according to a tenth embodiment of the present invention.

FIG. 13 is a schematic sectional view of the liquid ejection head 1 according to a tenth embodiment of the present invention. In the present embodiment, a plurality of second electric wiring boards 9 are provided, and each second electric wiring board 9 is connected to the first electric wiring board 7. The integrated circuit element 10 is mounted on each of the second electric wiring boards 9. A plurality of integrated circuit elements 10 may be mounted on each of the second electric wiring boards 9.

Eleventh Embodiment

Figure 14:
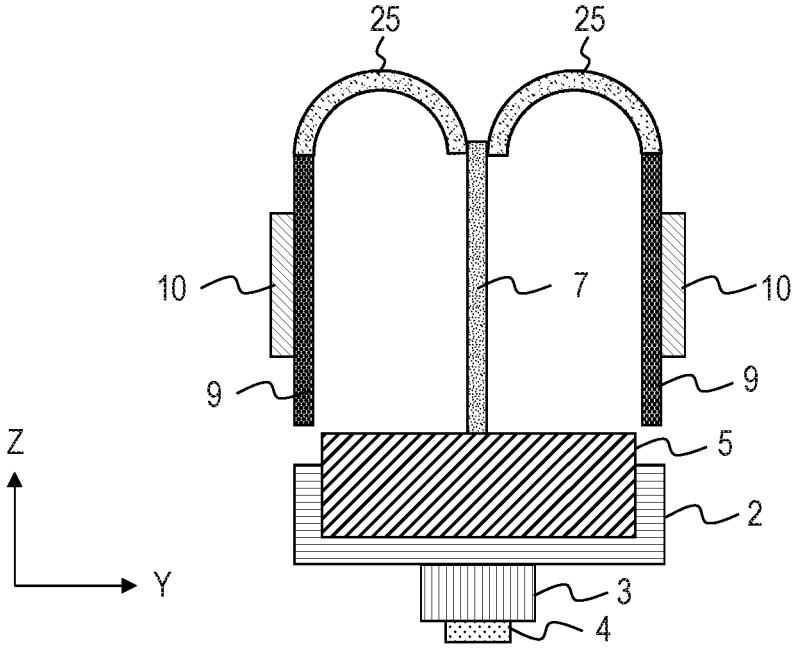
FIG. 14 is a conceptual diagram of a liquid ejection head according to an eleventh embodiment of the present invention.

FIG. 14 is a schematic sectional view of the liquid ejection head 1 according to an eleventh embodiment of the present invention. In the present embodiment, as in the eighth embodiment, the first electric wiring board 7 and the second electric wiring board 9 are connected through an electric wiring member 25. The electric wiring member 25 is curved such that the first electric wiring board 7 and the second electric wiring board 9 face each other. In the present embodiment, since the two second electric wiring boards 9 are located at symmetrical positions, the influence of heat conduction and heat radiation from the two second electric wiring boards 9 is substantially equal. In addition, since it is easy to ensure the path length of heat conduction, the influence of heat conduction is further reduced.

Twelfth Embodiment

FIG. 15 is a schematic sectional view of the liquid ejection head 1 according to a twelfth embodiment of the present invention. In the present embodiment, the integrated circuit element 10 is provided on a surface of the second electric wiring board 9 where the surface of the second electric wiring board 9 faces the element substrate 4. When the second housing 14 is not provided, the integrated circuit element 10 may be destroyed by the influence of static electricity or the like. Specifically, when unpacking the liquid ejection head 1 packed with the packaging material and attaching the liquid ejection head 1 to the printer main body, there is a possibility that the integrated circuit element 10 may be electrostatically destroyed by a human hand contacting the integrated circuit element 10. In the present embodiment, since the integrated circuit element 10 is protected by the second electric wiring board 9, it is not likely that a human hand or the like contacts the integrated circuit element 10. Although the influence of heat radiation occurs somewhat in the present embodiment, since the integrated circuit element 10 is protected by the second electric wiring board 9, the possibility of electrostatic destruction can be reduced. Note that the feature of the positioning of the integrated circuit element 10 in this embodiment can also be applied to other embodiments.

According to the above configuration, it is possible to reduce the influence of heat generated in the integrated circuit element without using additional members such as a heat insulating member and a heat radiation unit. Therefore, according to the present invention, it is possible to provide a liquid ejection head capable of reducing influence of heat generated by an integrated circuit element on ejection performance with a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-126305, filed Jun. 28, 2017, which is hereby incorporated by reference herein in its entirety.

What is claimed is:

1. A liquid ejection head comprising:

a liquid ejection unit having an element substrate including an energy-generating element that applies energy for ejecting liquid;

a liquid supplying unit that is fluidically connected to the liquid ejection unit, and that supplies liquid supplied from a printer main body to the element substrate of the liquid ejection unit;

a first electric wiring board electrically connected to the element substrate and being provided independently from the liquid ejection unit and the liquid supplying unit; and a second electric wiring board on which an integrated circuit element is mounted, the second electric wiring board being electrically connected to the first electric wiring board and being provided independently from the liquid ejection unit and the liquid supplying unit, wherein an electric signal is supplied to the integrated circuit element mounted on the second electric wiring board through the first electric wiring board, the electric signal is processed by the integrated circuit element, and the electric signal is supplied to the energy-generating element through the second electric wiring board and the first electric wiring board.

2. The liquid ejection head according to claim 1, wherein the second electric wiring board is disposed further away from the element substrate than the first electric wiring board is from the element substrate.

3. The liquid ejection head according to claim 1, wherein the element substrate, the first electric wiring board, and the second electric wiring board form part of a heat conduction path made of a solid material which is continuously connected from the integrated circuit element to the element substrate, and on the heat conduction path, the first electric wiring board is positioned between the element substrate and the second electric wiring board.

4. The liquid ejection head according to claim 1, wherein a space containing air is provided between the second electric wiring board and the liquid ejection unit having the element substrate.

5. The liquid ejection head according to claim 1, wherein the first electric wiring board and the second electric wiring board are arranged in non-parallel directions relative to each other.

6. The liquid ejection head according to claim 1, comprising a plurality of second electric wiring boards, wherein each of the second electric wiring boards is connected to the first electric wiring board.

7. The liquid ejection head according to claim 1, comprising a plurality of first electric wiring boards, wherein the second electric wiring board is connected to each of the first electric wiring boards.

8. The liquid ejection head according to claim 1, wherein the first electric wiring board has a first signal terminal that supplies and receives the electric signal, the second electric wiring board has a second signal terminal that supplies and receives the electric signal, and the first signal terminal and the second signal terminal are directly electrically connected to each other.

9. The liquid ejection head according to claim 1, wherein the first electric wiring board has a first power terminal that supplies driving power for driving the integrated circuit element to the second electric wiring board, the second electric wiring board has a second power terminal that receives the driving power from the first electric wiring board, and the first power terminal and the second power terminal are connected to each other by a cable.

10. The liquid ejection head according to claim 1, further comprising an electric wiring member that connects the first electric wiring board and the second electric wiring board.

11. The liquid ejection head according to claim 10, wherein the electric wiring member is curved such that the first electric wiring board and the second electric wiring board face each other.

12. The liquid ejection head according to claim 10, wherein the electric wiring member extends in a planar shape such that the first electric wiring board and the second electric wiring board are positioned on a same plane.

13. The liquid ejection head according to claim 1, wherein the integrated circuit element is provided on a surface of the second electric wiring board, the surface of the second electric wiring board facing the element substrate.

14. The liquid ejection head according to claim 1, wherein the integrated circuit element is provided on a first surface of the second electric wiring board, the first surface of the second electric wiring board being opposite to a second surface of the second electric wiring board, the second surface facing the element substrate.

15. The liquid ejection head according to claim 1, further comprising a pressure control mechanism that is fluidically connected to the liquid ejection unit, and that adjusts a negative pressure of a supply path of the liquid to a value in a predetermined range.

16. The liquid ejection head according to claim 1, wherein the liquid ejection head is a page-wide type liquid ejection head in which a plurality of the element substrates are arranged.

17. The liquid ejection head according to claim 16, wherein the plurality of the element substrates are linearly arranged.

18. The liquid ejection head according to claim 1, further comprising a pressure chamber having the energy-generating element therein, wherein liquid in the pressure chamber is circulated between the pressure chamber and outside of the pressure chamber.

* * * * *